US007182445B2

(12) United States Patent
Johnson et al.

(10) Patent No.: US 7,182,445 B2
(45) **Date of Patent: *Feb. 27, 2007**

(54) REPLACEABLE PRINTER COMPONENT

(75) Inventors: Bruce L. Johnson, Eagle, ID (US); Tom A. Skeie, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/423,863

(22) Filed: Apr. 25, 2003

(65) Prior Publication Data

US 2004/0212651 A1 Oct. 28, 2004

(51) Int. Cl.
*B41J 2/175* (2006.01)

(52) U.S. Cl. ..... 347/86; 347/7; 347/19

(58) Field of Classification Search ..... 347/19, 347/7, 86; 399/8, 12, 111; 705/1
See application file for complete search history.

(56) References Cited

U.S. PATENT DOCUMENTS

| | | | | |
|---|---|---|---|---|
| 5,049,898 | A | 9/1991 | Arthur et al. | 347/19 |
| 5,949,467 | A | 9/1999 | Gunther et al. | 347/214 |
| 5,995,774 | A | 11/1999 | Applegate et al. | 399/27 |
| 6,161,915 | A | 12/2000 | Bolash et al. | 347/19 |
| 6,351,621 | B1 * | 2/2002 | Richards et al. | 399/111 |
| 6,361,138 | B1 * | 3/2002 | Seino et al. | 347/19 |
| 6,416,154 | B1 | 7/2002 | Silverbrook | 347/19 |
| 6,625,402 | B2 * | 9/2003 | Takemoto | 399/8 |
| 6,672,695 | B1 * | 1/2004 | Naka et al. | 347/7 |
| 2002/0030712 | A1 | 3/2002 | Silverbrook | 347/19 |
| 2002/0038222 | A1 * | 3/2002 | Naka | 705/1 |
| 2002/0135647 | A1 | 9/2002 | Ansell et al. | 347/86 |

OTHER PUBLICATIONS

Phillip Robinson, "Printer markers' ink 'lock-ins' could be costly", http://www.laserprintdoctor,com/ 2002 The Laser Print Doctor, pp. 1-3.

Dawn C. Chmielewski, "Printer industry seeks to keep lock on cartridge profit," http://www.charlotte.com, Mercury News, Jan. 16, 2003 pp. 1-3.

* cited by examiner

*Primary Examiner*—Stephen Meier
*Assistant Examiner*—Lam Nguyen

(57) ABSTRACT

A replaceable printer component comprises a printer component and a memory. The printer component is configured for removable installation into, and for electronic communication with, a printer. The memory is configured for storing a first unique identifier that represents one or more printers for which use of the printer component is exclusively authorized.

19 Claims, 5 Drawing Sheets

REPLACEABLE PRINTER COMPONENT

BACKGROUND OF THE INVENTION

The art of inkjet technology is relatively well developed. Commercial products such as computer printers, graphics plotters, and facsimile machines have been implemented with inkjet technology for producing printed media. Generally, an inkjet image is formed pursuant to precise placement on a print medium of ink drops emitted by an ink drop generating device known as an inkjet printhead assembly. An inkjet printhead assembly includes at least one printhead. Typically, an inkjet printhead assembly is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

Inkjet printers have at least one ink supply. An ink supply includes an ink container having an ink reservoir. The ink supply can be housed together with the inkjet printhead assembly in an inkjet cartridge or pen, or can be housed separately. When the ink supply is housed separately from the inkjet printhead assembly, users can replace the ink supply without replacing the inkjet printhead assembly. The inkjet printhead assembly is then replaced at or near the end of the printhead life, and not when the ink supply is replaced.

Current printer systems typically include one or more replaceable printer components, including inkjet cartridges, inkjet printhead assemblies, and ink supplies. Some existing systems provide these replaceable printer components with on-board memory to communicate information to a printer about the replaceable component, such as ink fill level, marketing information, etc. The ink level information can be transmitted to the printer to indicate the amount of ink remaining. A user can observe the ink level information and anticipate the need for replacing a depleted ink container.

Printer cartridge replacement has evolved into a major business for manufacturers of printers, and a significant operating expense for companies using printers. Accordingly, this business relationship will continue to evolve and draw increasing attention from both consumers and printer manufacturers.

SUMMARY OF THE INVENTION

A replaceable printer component comprises a printer component and a memory. The printer component is configured for removable installation into, and for electronic communication with, a printer. The memory is configured for storing a first printer unique identifier that represents one or more printers for which use of the printer component is exclusively authorized.

DESCRIPTION OF THE PREFERRED EMBODIMENTS

In the following detailed description of the preferred embodiments, reference is made to the accompanying drawings that form a part hereof, and in which is shown, by way of illustration, specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
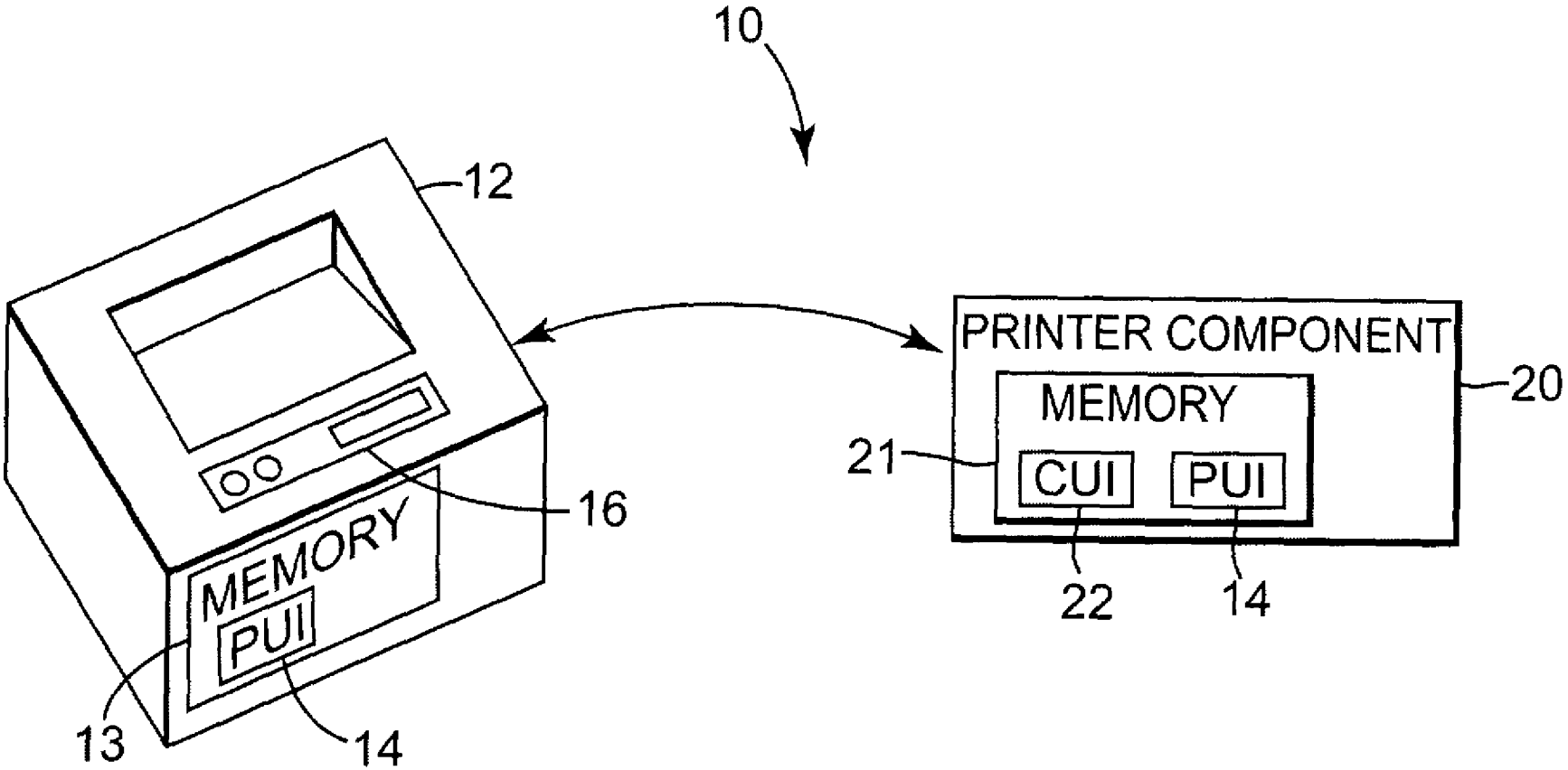
FIG. 1 is a perspective view of a replaceable printer component system, according to an embodiment of the present invention.

In one exemplary embodiment, printing system 10 of the present invention is shown in FIG. 1. Printing system 10 comprises printer 12 and printer component 20. Printer 12 comprises, among other things, memory 13 for storing printer unique identifier (PUI) 14 and user interface 16. Replaceable printer component 20 comprises, among other things, memory 21 for storing printer unique identifier 14 and for optionally storing component unique identifier (CUI) 22. Printer component 20 comprises any component of printer 12 that is replaceable, and which can be removably installed in printer 12. In one example, printer component 20 is a consumable, such as an inkjet cartridge, inkjet printhead assembly, printhead and ink supply, toner supply, toner reservoir, as well as sub-components and combinations of those components.

Printer unique identifier) 14 is an alphanumeric string or other computer readable symbolic representation that uniquely identifies printer 12 and is stored in memory 13 of printer 12 and in memory 21 of component 20. Component unique identifier 22 also is an alphanumeric string or other computer readable symbolic representation that uniquely identifies component 20 and is optionally stored in memory 21 of printer component 20.

Printer unique identifier 14, when stored in memory 21 of printer component 20, uniquely associates replaceable printer component 20 with printer 12. Printer unique identifier 14 is electronically written into memory 21 of printer component 20 by printer 12 or through other means, which will be later described in detail in association with FIG. 5.

Both printer 12 and printer component 20 are configured so that printer component 20 functions exclusively only with a printer, such as printer 12, that has a corresponding printer unique identifier 14 stored in its memory (e.g. memory 13) that matches the printer unique identifier 14 stored in memory 21 of printer component 20. If printer component 20 is removably installed in a printer (e.g., a second printer) that has a printer unique identifier 14 that does not match a printer unique identifier stored in memory 21 of printer component 20, then printer component 20 will not function with that printer. Likewise, if printer component 20 is removably installed in a printer (e.g., a third printer) that does not have any printer unique identifier, then printer component 20 having printer unique identifier 14 will not function with that printer.

This arrangement insures that once printer component 20 is removably installed in printer 12, and once there is electronic confirmation that printer component 20 holds printer unique identifier 14 that matches printer unique identifier 14 of printer 12, printer component 20 becomes electronically locked to that printer 12. In this arrangement, printer component 20 can still be physically removed after electronic locking to printer 12. However, this electronic locking feature nearly eliminates any incentives to remove printer component 20 from printer 12 for use in another printer, because printer component 20 will not be capable of operation in any unauthorized printer (i.e., one not carrying the same printer unique identifier 14 that is stored in memory 21 of printer component 20).

Figure 2:
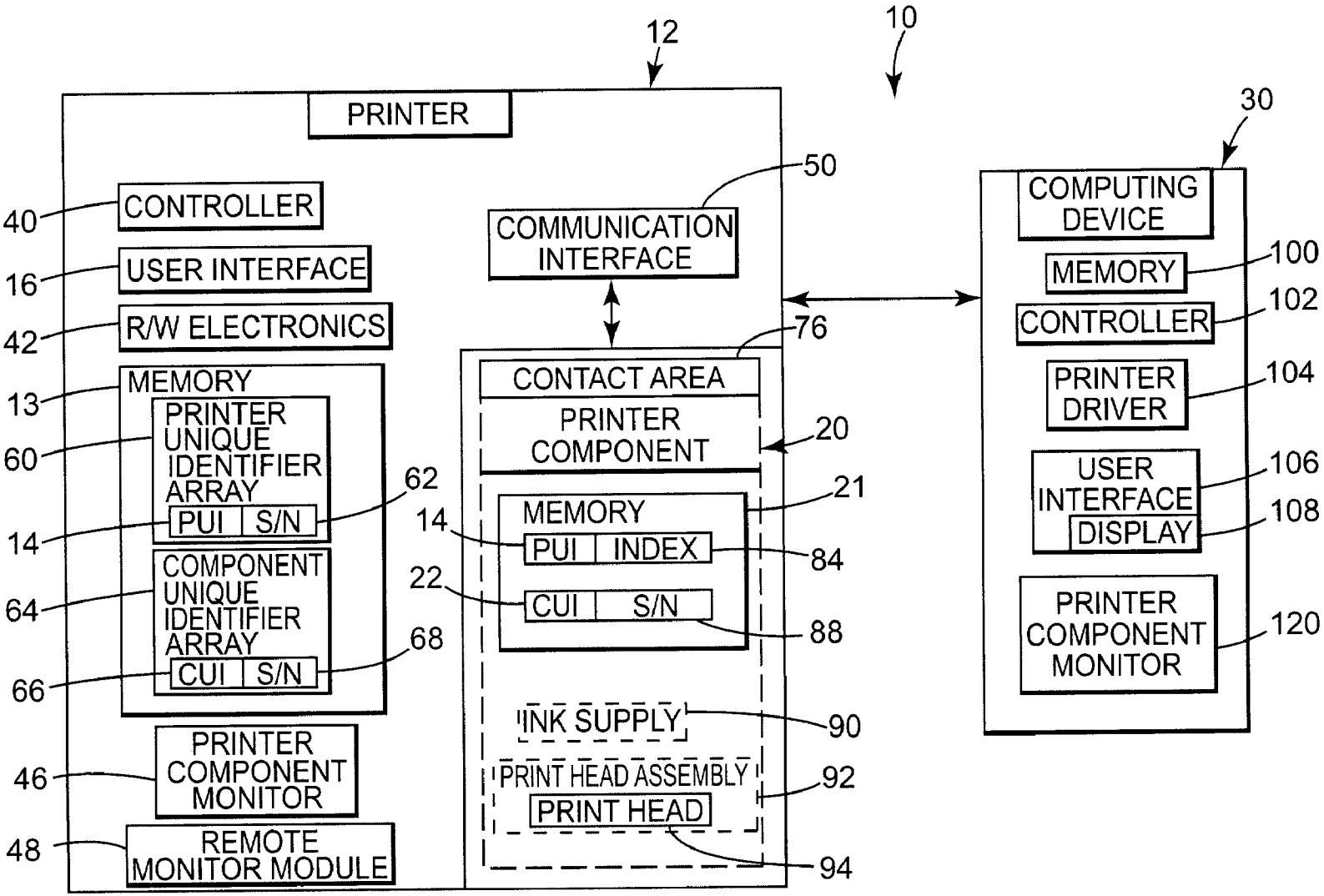
FIG. 2 is a block diagram of a replaceable printer component system, according to an embodiment of the present invention.

FIG. 2 shows printing system 10 of the present invention in greater detail. As shown in FIG. 2, printer 12 comprises user interface 16, controller 40, read/write (R/W) electronics 42, memory 13, component monitor 46, remote monitor module 48, and component communication interface 50.

User interface 16 of printer 14 is used to access and manage all of the conventional features printer 12 (e.g., start, stop, etc.) as well as for reviewing and managing electronic locking of printer component 20 relative to printer 12, in accordance with one embodiment of the present invention.

Memory 13 of printer 12 stores array 60 of a plurality of printer unique identifiers 14 (herein PUI array 60), and array 64 of a plurality of component unique identifiers (CUIs) 66 (herein CUI array 64). Each printer unique identifier 14 optionally comprises serial number (S/N) 62 while each component unique identifier 66 optionally comprises serial number (S/N) 68. Each printer unique identifier 14 uniquely identifies one or more printers 12 for association with printer components 20. More than one printer 12 can be associated with a single printer component 20. Likewise, more than one printer component 20 can be associated with a single printer 12.

Memory 13 of printer 12 comprises computer readable media, which also stores any related software, and can include any combination of volatile or non-volatile memory, such as floppy disks, hard disks, CD-ROMs, flash memory, read-only memory (ROM), and random access memory (RAM).

Controller 40 of printer 12 directs operation of all components and functions of printer 12, in cooperation with printer driver 104 of computing device 30 (described later in more detail). Controller 40 performs its operations, with an operating system, such as a Microsoft® brand operating system or other printer-specific operating system stored in memory 13.

Read/write electronics 42 of printer 12 is a read/write head and supporting circuitry capable of reading and writing to memory 21 of printer component 20 via communication interface 50 of printer 12. Read/write electronics 42 is used to write printer unique identifier 14 into, and read printer unique identifier(s) 14 from, memory 21 of printer component 20 that is removably installed in printer 12.

Component communication interface 50 comprises an electrical contact area that establishes electrical communication with a reciprocal electrical contact area 76 of printer component 20 to permit communication between R/W electronics 42 of printer 12 and memory 21 of printer component 20. In particular, communication interface 50 of printer 12 and electrical contact area 76 of printer component 20 comprises electrically conductive elements provided in the forms of well known electrically conductive contact pins, card-receiving slot, etc. that are suited for removably establishing contact with reciprocating electrically conductive contact elements.

Printer component monitor 46 manages which printer components 20 are logically linked to printer 12 (via printer unique identifiers 14) and includes the capability of assigning printer unique identifiers 14 to printer components 20. In addition, printer component monitor 46 performs electronic confirmation that the printer unique identifier 14 of printer component 20 matches printer unique identifier of 12. Printer component monitor 46 is described in greater detail later in association with FIG. 3.

Remote monitor module 48 of printer 12 is optionally included to enable remote monitoring of printer 12 and in particular to permit, electronic access and control over printer component monitor 46. This arrangement permits off-site management and monitoring of printer components 20 to insure that a printer component 20 remains installed in the printer 12 to which that printer component 20 has been assigned. For example, an administrator optionally uses remote monitor module 48 to periodically confirm that printer component 20 has the same printer unique identifier 14 as printer 12. Remote monitor module 48 is implemented through dedicated control languages, such as Printer Job Language (i.e., PJL) and/or Printer Management Language (i.e., PML), as well as optionally implemented through an embedded web server, such as those disclosed in U.S. Pat. Nos. 5,596,487, and 6,107,007, which are hereby expressly incorporated by reference.

As further shown in FIG. 2, printer component 20 comprises memory 21, which includes at least one printer unique identifier (PUI) 14, PUI index 84, and component unique identifier 22 optionally having serial number 88. If printer component 20 is electronically assigned or authorized for use by multiple printers 12, then PUI index 84 stores a list of printers 13 for which use with printer component 20 is authorized.

Memory 21 of printer component 20 comprises an electronically programmable read-only memory (EPROM). Moreover, memory 21 optionally comprises a one-time writable memory so that only one printer unique identifier 14 can be written to printer component 20 only a single time. Alternatively, in other embodiments memory 21 is a programmable read-only memory (PROM) that can be written to multiple times for assigning multiple printer unique identifiers to printer component 20 at different points in time, or even at a single point in time.

Printer component 20 optionally includes any one or more of ink supply (or toner supply, toner reservoir) 90, printhead assembly 92, and/or printhead 94. Printer component 20 is easily physically installed and removed from printer 12, in a manner well known in the art.

For example, when printer component 20 is embodied as an ink jet cartridge (or laser toner supply/reservoir), it is installed and used with printer 12 until the ink supply of ink jet cartridge is emptied. At that time, the ink jet cartridge is removed and replaced by another ink jet cartridge. Of course, the ink jet cartridge can be removed, before the ink supply is emptied, for placement in another printer. However, since the ink jet cartridge (e.g., printer component 20) stores printer unique identifier 14 in its memory 21, that ink jet cartridge will not be usable in another printer (i.e., one different than printer 12) that lacks the same printer unique identifier. This security feature prevents employee theft or migration of office supplies to unwanted locations.

Computing device 30 is provided for operating printer 12 and comprises memory 100, controller 102, printer driver 104, user interface 106 with display 108, and optional printer component monitor 120. Printer component monitor 120 has substantially the same features and attributes as printer component monitor 46 of printer 12.

Controller 102 of computing device 30 includes both electronics and firmware for the control of the various components or sub-assemblies of computing device 30 and of printer 12. Controller 102 employs an operating system, such as a Microsoft® operating system, Linux-based system, or other printer-specific operating system stored in memory 100. Printer driver 104 cooperates with controller 102 to execute commands and software specific to operation of printer 12. Printer component monitor 120 acts in cooperation with printer driver 104 and controller 102, to control electronic authorization of printer component 20 with printer 12. User interface 106 of computing device 30 permits access to and operation of print driver 104 and printer component monitor 120.

Figure 3:
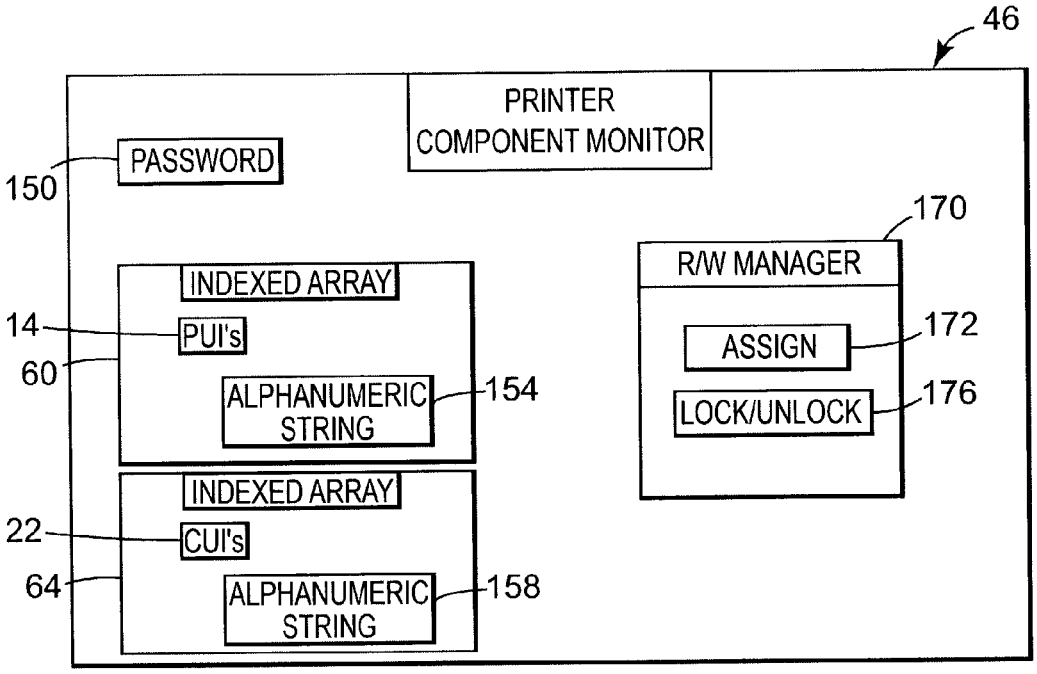
FIG. 3 is block diagram of a printer component monitor, according to an embodiment of the present invention.

Accordingly, using functions and features described in association with FIG. 3, printer component 20 is removably installed in printer 12 and electronically locked for exclusive use with printer 12 when printer unique identifier 14 of printer 12 is present in memory 21 of printer component 20.

As shown in FIG. 3, printer component monitor 46 comprises password function 150, indexed array 60 of a plurality of printer unique identifiers (PUIs) 14, optionally expressed as alphanumeric string(s) 154, and indexed array 64 of a plurality of component unique identifiers (CUIs) 22 (optionally expressed as alphanumeric strings 158). Read/write (R/W) manager 170 comprises assign function 172, and selective locking function 176.

Via read/write manager 170, printer component monitor 46 of the present invention permits a user to assign printer unique identifier 14 (via assignment function 172) to printer component 20, which is then stored in memory 21 of printer component 20. In addition, printer component monitor 46 optionally permits review of component unique identifier 22 and assignment of component unique identifier 22 to printer components 20.

Upon installation of printer component 20 in printer 12, printer component monitor 46 recognizes the presence of printer component 20 via communication interface 50 and electronically confirms whether or not printer component 20 stores a matching printer unique identifier 14 in its memory 21. Using the read/write manager 170 (via user interface 16 of printer 12 and user interface 106 of computing device 30), printer 12 then requests the user to select whether printer component 20 will be electronically locked to printer 12. If requested by user, read/write manager 170 assigns (via assignment function 172) printer unique identifier 14 to printer component 20, and then writes printer unique identifier 14 to printer component 20 (via read/write electronics 42).

Selective locking function 176 is an optional function that permits a user to selectively electronically lock and unlock printer component 20 to printer 12 (that bears the same printer unique identifier 14 as printer component 20). Accordingly, while printer unique identifier 14 remains stored in memory 21, printer component monitor 46 permits an administrator to temporarily activate or deactivate electronic locking feature on printer via function 176 for a period of time or indefinitely.

Printer component monitor 46 can reside on printer 12, computing device 30, or other devices in communication with printer 12 and/or computing device 30. For example, printer component monitor 46 can reside in a web site in communication directly with printer 12, or indirectly with printer 12 through computing device 30, as shown in greater detail in FIG. 4.

Figure 4:
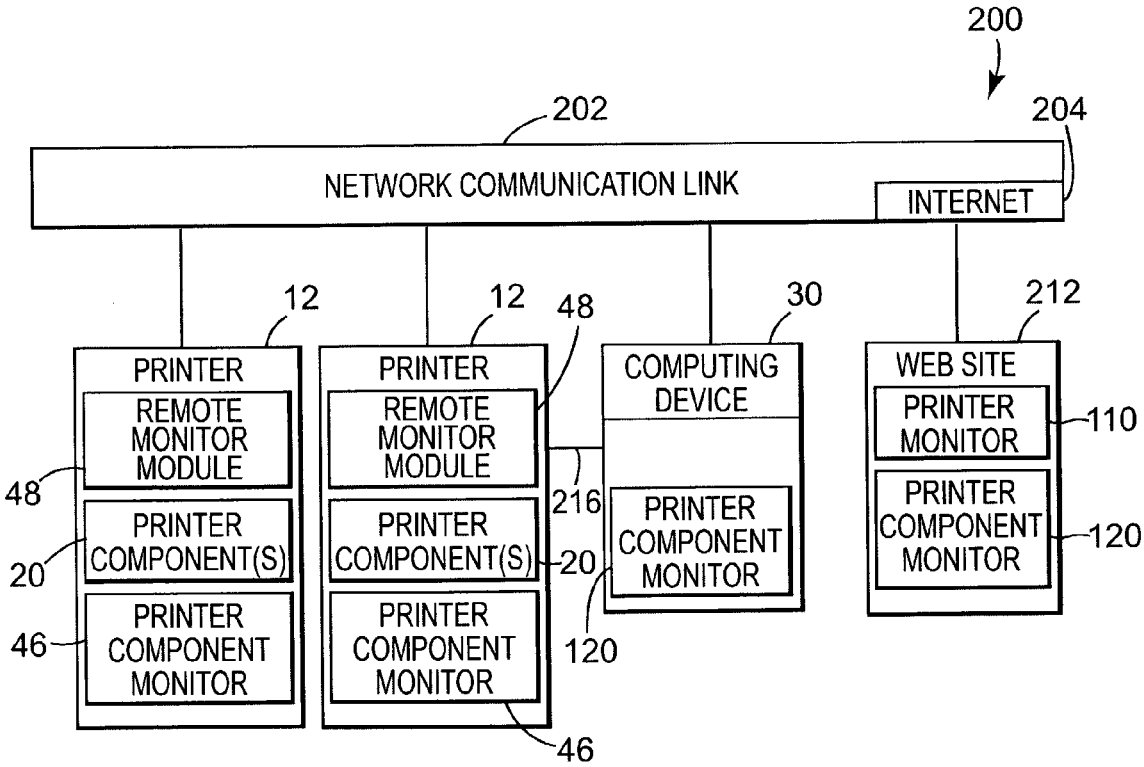
FIG. 4 is a block diagram of a printer component management system, according to an embodiment of the present invention.

As shown in FIG. 4, remote printer management system 200 of the present invention includes one or more printer(s) 12, computing device 30, network communication link 202, and web site 212. Each printer 12 includes all of components shown and described in FIGS. 1–3, including remote monitor module 48 and printer component 20. Computing device 30 includes all of the components shown and described in FIGS. 1–3, including printer component monitor 120. Web site 212 includes printer monitor 110 and component monitor 120.

Network communication link 202, as used herein, includes an internet communication link (e.g., the Internet), an intranet communication link, or similar high-speed communication link. In one preferred embodiment, network communication link 202 includes an Internet communication link 204. Network communication link 202 permits communication between printer 12, computing device 30 and web site 212. However, one or more printers 12 can be connected directly to computing device 30 via direct communication link 216.

Web site 212 and/or computing device 30 exert control over printer 12 via remote monitor module 48 (FIG. 2) to monitor printer components 20, particularly for determining whether or not each printer component 20 is locked, present, etc. In this way, an administrator can be located remotely to printers 12 and still determine is printer components 20 are properly located within printers 12.

Figure 5:
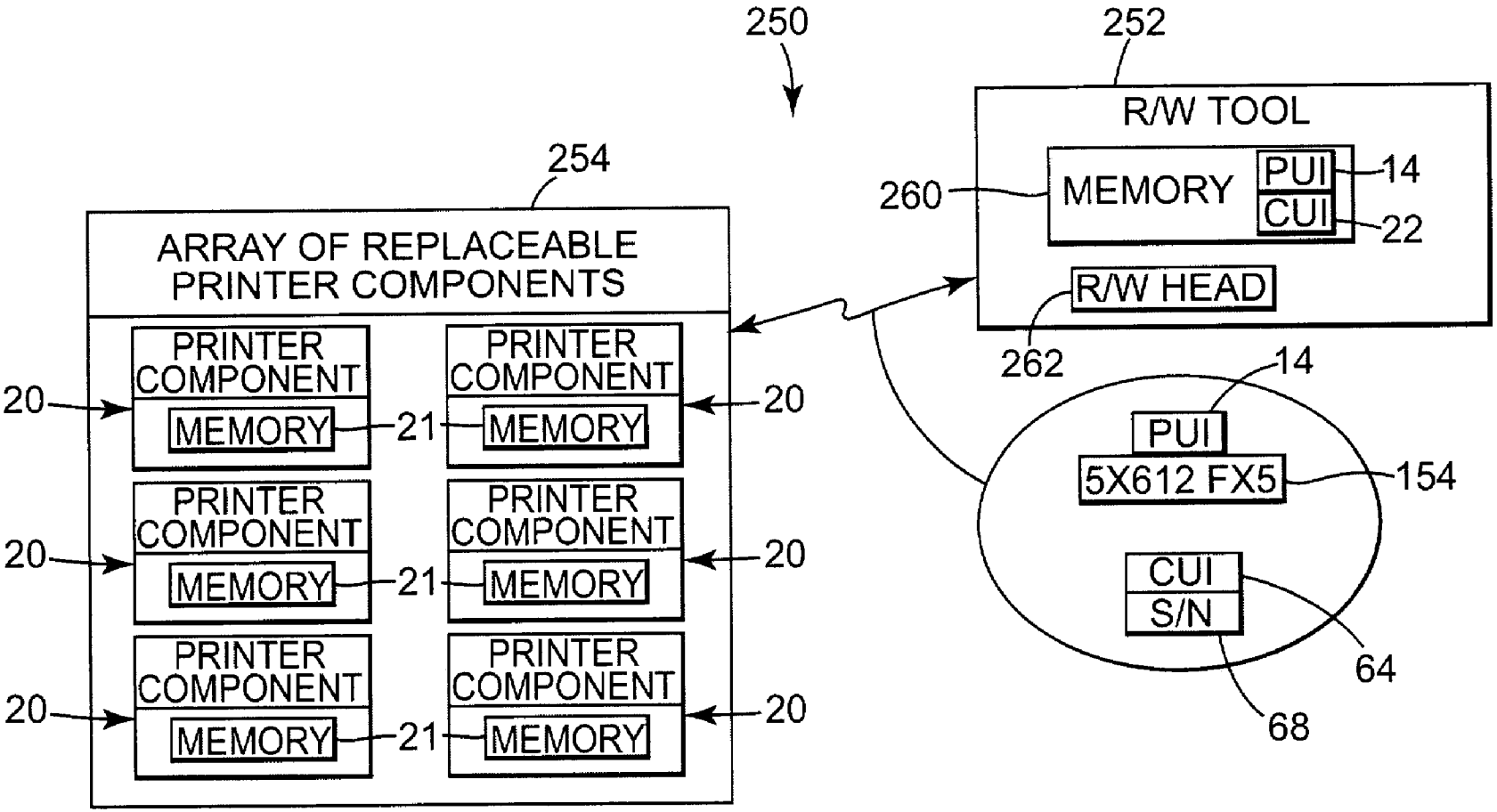
FIG. 5 is a schematic illustration of a printer component management tool, according to an embodiment of the present invention.

FIG. 5 illustrates system 250 of the present invention for assigning printer unique identifiers 14 to array 254 of replaceable printer components 20, or any single replaceable printer component 20 within array 254. System 250 includes read/write (R/W) tool 252 that is configured to assign and write printer unique identifier 14, such as an alphanumeric string 154 (e.g., 5X612FX5) to printer component 20, and optionally assign and write a component unique identifier 64 (optionally serial number 68) to printer component 20. The same single printer unique identifier 14 or plurality of different printer unique identifiers 14 can be written into every printer component 20 within array 254.

Read/write tool 252 comprises memory 260 and read/write head 262. Memory 260 is configured for storing one or more printer unique identifiers 14 and component unique identifier(s) 22, and has substantially the same attributes and features as memory 13 of printer 12 (FIG. 2).

Read/write tool 252 writes printer unique identifier 14 from its memory 260 into memory 21 (FIG. 2) of each printer component 20. Read/write tool 252 also is used to read memory 21 of each printer component 20 to check the status of memory 21 before, during and/or after writing printer unique identifier 14 into memory 21 of printer component 20.

In one embodiment, read/write tool 252 is implemented in printer 12 as the combination of read/write electronics 42 (FIG. 2) and component communication interface 50, with read/write head 262 being implemented as read/write electronics 42 of printer 12, and memory 260 of read/write tool 252 being implemented as memory 13 of printer 12.

Alternatively, in another embodiment, read/write tool 252 optionally comprises a free-standing read/write tool 252 that includes memory 260 and read/write head 262 having read/write electronics substantially similar to read/write electronics 42 of printer 12 and that uses wired and/or wireless communication to communicate with memory 21 of printer component 20. This read/write tool 252 can be used (to write printer unique identifiers 14 into memory 21 of printer components 20) at any one or more steps of manufacturing, packaging, and shipping printer components 20 to a consumer and/or sales personnel. Like wise, read/write tool 252 can be used for writing printer unique identifiers 14 when receiving and installing printer components 20 into printers 12.

Accordingly, printer component 20 can be assigned to printers 12 via assignment of printer unique identifiers 14 to printer components 20 before printer components 20 are sold, or some time before arriving at their installation site, thereby providing greater control over management of printing supplies.

Figure 6:
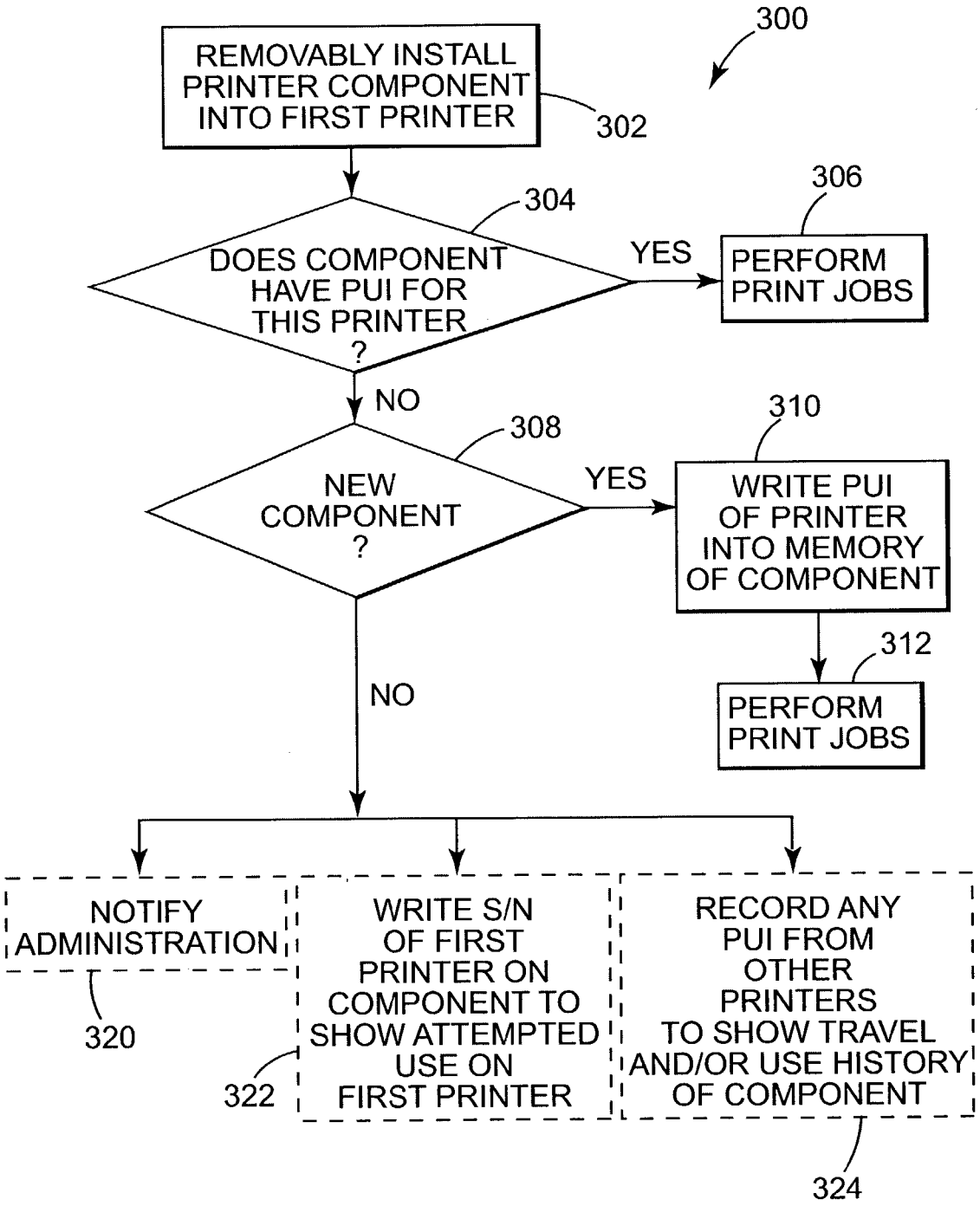
FIG. 6 is flow diagram of a method of managing replaceable printer components, according to an embodiment of the present invention.

FIG. 6 illustrates a flow diagram illustrating method 300 of the present invention of managing replaceable printer components. Method 300 comprises removably installing printer component(s) 20 into first printer 12 (shown in box 302) and, as shown in box 304, querying whether printer component(s) 20 has a printer unique identifier 14 stored in memory 21 (FIG. 2) of printer component 20 that matches printer unique identifier 14 of first printer (into which printer component 20 was installed).

If the query yields an affirmative response (printer component 20 has a PUI 14 that matches PUI 14 of first printer), then printer 12 is permitted to use printer component 20 to perform print jobs (box 306) and other functions of printer 12. If the query yields a negative response (printer component 20 lacks a printer unique identifier 14 at all, or one matching PUI 14 of first printer), then a further query is made whether printer component 20 is a new component that has not been previously installed on any printer 12 (box 308).

If the query yields an affirmative response (printer component 20 has not been previously installed), then printer 12 writes its printer unique identifier 14 into memory 21 (FIG. 2) of printer component 20 (box 310) and then uses printer component 20 to perform a print job using printer component 20 (box 312).

If the query yields a negative response (printer component 20 has been previously installed, but not on first printer 20), then any one or more actions may follow. First, printer 12 can notify administrator of the situation (box 320). Printer 12 also can write a serial number of the first printer into memory 21 of printer component 20 to show that an attempted use of non-authorized printer component 20 was made on first printer 12. Printer 12 also can access serial number or component unique identifier 22 from printer component 20 and save that information in printer 12 for tracking presence of printer component 20 (box 324). Finally, printer 12 can retrieve any printer unique identifiers 14 from memory 21 of printer component 20 to obtain a travel/use history of printer component 20.

A method and system of the present invention is directed to managing printer components. By storing a unique identifier of a printer in a memory of a replaceable printer component, the printer component can be electronically locked to function only with a printer having the same printer unique identifier as the printer component. Management of large volumes of printer components is enhanced since this method and system inhibits free migration of printer components throughout an office or even out of the office.

While specific embodiments have been illustrated and described, herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A replaceable printer component comprising:

a single printer component configured for removable installation into, and for electronic communication with, a first single printer; and a permanent read-only memory configured for one-time writing of information to the permanent read-only memory, the memory configured for storing, only after an initial removable installation of the single printer component into the first single printer, a first single printer unique identifier that uniquely represents only the first single printer relative to other single printers to lock operation of the single printer component exclusively with the first single printer and to prevent later operation of the single printer component with the other single printers, wherein the memory is configured for storing a plurality of printer unique identifiers via the one-time writing of information, including the first printer unique identifier, in association with a group of authorized single printers, including the first single printer, with each printer unique identifier uniquely representing a different authorized single printer of the group of authorized single printers for which use of the single printer component is exclusively enabled, thereby preventing later operation of the single printer component with other single printers outside the group of authorized single printers.

2. The replaceable printer component of claim 1 comprising at least one of an ink reservoir, an ink supply, a toner reservoir, a toner supply, a printhead, and a printhead assembly.

3. The replaceable printer component of claim 1 wherein the memory of the replaceable printer component is configured to store a serial number of the first single printer as the first single printer unique identifier of the first single printer.

4. The replaceable printer component of claim 1 wherein the memory is configured to store a first component unique identifier that uniquely represents the replaceable printer component distinct from other replaceable printer components wherein the first component unique identifier is also configured for storage in a memory of the first single printer for tracking by the first single printer of use of the first replaceable printer component with the first single printer.

5. The replaceable printer component of claim 1 and further comprising a system, the system comprising:

a read/write tool comprising:

a memory configured for storing the first single printer unique identifier; and a read/write head configured for writing the first single printer unique identifier into the memory of the replaceable printer component.

6. The replaceable printer component of claim 1 comprising:

the memory configured for storing a component unique identifier that uniquely represents the replaceable printer component wherein the component unique identifier is configured for storage in a memory of the first printer for tracking, by the first printer, of use of the replaceable printer component with the first printer, and wherein the first single printer unique identifier is a different alphanumeric identifier than the component unique identifier.

7. A printer system comprising:

a first single printer including a first unique identifier that represents only the first single printer apart from other single printers;

a printing mechanism comprising a replaceable printer component removably installed into the first single printer, the replaceable printer component including at least one of an ink cartridge, an ink supply, a toner reservoir, a toner supply, a printhead, and a printhead assembly, and the replaceable printer component including a first memory that excludes the first unique identifier prior to removable installation of the replaceable printer component into the first single printer; and a read/write manager including:

a second memory configured to store the first unique identifier;

an assignment function configured for assigning the replaceable printer component with the first unique identifier;

an electronic locking function configured for selectively activating the first single printer for exclusive use with the replaceable printer component based on the first unique identifier and for selectively deactivating the first single printer to prevent later use of die replaceable printer component with the first single printer, wherein the read/write manager is configured to electronically write the first unique identifier into the first memory of the replaceable printer component upon removable installation of the replaceable printer component into the printing mechanism, and wherein the first unique identifier stored in the first memory of the replaceable printer component enables operation of the replaceable printer component exclusively with the first single printer to prevent later operation of the replaceable printer component with the other single printers.

8. The printer system of claim 7 wherein the first single printer comprises a printer component monitor configured for electronically confirming that the replaceable printer component removably installed within the first single printer has the same first unique identifier as the first single printer.

9. A method of managing a printer component, the method comprising:

providing a printer component configured with a memory and configured for electronic communication with a first single printer; and electronically writing into the memory of the printer component a first single printer unique identifier that uniquely represents only the first single printer;

removably installing the printer component into the first single printer;

electronically enabling operation of the printer component with the first single printer upon electronic confirmation that the memory of the printer component stores the first single printer unique identifier; and electronically preventing, via the first single printer unique identifier stored in the memory of the printer component, later operation of the printer component upon removal of the printer component from the first single printer and re-installation of the printer component into other single printers that have other single printer unique identifiers different than the first single printer unique identifier.

10. The method of claim 9 and further comprising:

electronically preventing use of the printer component with one of the other single printers not having any single printer unique identifier.

11. The method of claim 9 wherein providing a printer component comprises:

providing the printer component as at least one of an ink jet cartridge, an ink supply, an ink reservoir, a toner reservoir, a toner supply, a printhead, and a printhead assembly.

12. The method of claim 9 wherein electronically writing into the memory of the printer component comprises using the first single printer to electronically write the first single printer unique identifier into the memory of the printer component.

13. The method of claim 9 wherein electronically writing the first single printer unique identifier comprises:

electronically transmitting, via a web site, the first single printer unique identifier through a network communication link to the first single printer for electronically writing the first single printer unique identifier into the memory of the first single printer.

14. The method of claim 9 wherein electronically writing into the memory of the printer component comprises:

storing within a memory of a read/write tool the first single printer unique identifier that represents the first single printer for which use of an array of the replaceable printer components will be exclusively authorized; and electronically writing, from the memory of the read/write tool, the first single printer unique identifier into the memory of each one of the printer components of the may of printer components.

15. A computer readable medium having computer-executable instructions for performing a method of managing a replaceable printer component, the method comprising:

electronically writing directly from a first single printer a first unique identifier, uniquely representing the first single printer apart from other single printers, permanently into a memory of a printer component that is removably installed in the first single printer; and electronically enabling use of the printer component with the first single printer only when the memory or the printer component stores the first unique identifier of the first single printer; and electronically preventing later use of the printer component upon reinstallation of the printer component in a second single printer having a second unique identifier that is different than the first unique identifier.

16. A method of managing a printer comprising:

removably installing a replaceable printer component into a first single printer;

identifying the first single printer via a first single printer unique identifier stored in a memory of the first single printer; and electronically locking, via the first single printer unique identifier, the replaceable printer component to the first single printer to prevent later operation of the replaceable printer component with a second single printer different than the first single printer.

17. The method of claim 16 and further comprising:

electronically writing, directly from a memory of the first single printer, the first single printer unique identifier into a memory of the replaceable printer component.

18. The method of claim 17, and comprising:

selecting by the user, via a user interface of the first single printer, the first single printer unique identifier to be different than a serial number of the first single printer.

19. The method of claim 16, wherein providing an array of single printers including the first single primer and the second single printer; and monitoring, via a printer component monitor of a website in network linked communication with a remote monitor module of each respective printer of the may of single printers, in which of the respective single printers that the replaceable printer component is removably installed.

* * * * *

UNITED STATES PATENT AND TRADEMARK OFFICE

CERTIFICATE OF CORRECTION

PATENT NO. : 7,182,445 B2
APPLICATION NO. : 10/423863
DATED : February 27, 2007
INVENTOR(S) : Bruce L. Johnson et al.

It is certified that error appears in the above-identified patent and that said Letters Patent is hereby corrected as shown below:

In column 9, line 31, in Claim 7, delete "die" and insert -- the --, therefor.

In column 10, line 36, in Claim 14, delete "may" and insert -- array --, therefor.

In column 10, line 46, in Claim 15, delete "or" and insert -- of --, therefor.

In column 11, line 7, in Claim 19, delete "primer" and insert -- printer --, therefor.

In column 12, line 3, in Claim 19, delete "may" and insert -- array --, therefor.

Signed and Sealed this

Eleventh Day of August, 2009

David J. Kappos

David J. Kappos
*Director of the United States Patent and Trademark Office*